US007696871B2

(12) United States Patent
Villiger

(10) Patent No.: US 7,696,871 B2
(45) Date of Patent: Apr. 13, 2010

(54) SECURITY SYSTEM HAVING AD HOC NETWORKING OF INDIVIDUAL COMPONENTS

(76) Inventor: Peter Villiger, Mitteldorf 10, 5637 Beinwil (CH)

( * ) Notice: Subject to any disclaimer, the term of this patent is extended or adjusted under 35 U.S.C. 154(b) by 398 days.

(21) Appl. No.: 11/732,314

(22) Filed: Apr. 3, 2007

(65) Prior Publication Data

US 2007/0229258 A1 Oct. 4, 2007

(30) Foreign Application Priority Data

Apr. 3, 2006 (CH) ..... 00547/06

(51) Int. Cl.
*G08B 21/00* (2006.01)

(52) U.S. Cl. ..... 340/540; 340/568.1; 340/539.1; 340/693.5

(58) Field of Classification Search ..... 340/540, 340/541, 550, 571, 568.1, 539.1, 531, 691.1, 340/693.5, 568.7
See application file for complete search history.

(56) References Cited

U.S. PATENT DOCUMENTS 4,352,097 A * 9/1982 Hamann ..... 340/568.7
4,887,445 A * 12/1989 Beatty ..... 70/278.7
5,315,656 A * 5/1994 Devaux et al. ..... 705/50
5,615,247 A * 3/1997 Mills ..... 455/411
5,738,020 A * 4/1998 Correia ..... 109/51

FOREIGN PATENT DOCUMENTS

CH 01532/04 7/2005

* cited by examiner

*Primary Examiner*—Daniel Previl
(74) *Attorney, Agent, or Firm*—McCarter & English LLP

(57) ABSTRACT

A security system (100) for storing and transporting valuables, the security system (100) comprising at least one security container (20) for receiving valuables having a protection mechanism for protecting the valuables. Furthermore, the security system (100) comprises a storage container (30) or receiving and storing the security container (20). An electrical protection circuit is provided in the security container (20), which comprises an infrared receiver, the protection mechanism of the security container (20) being able to be put into a first protection mode and a second protection mode. An electrical control circuit is provided in the storage container (30), which comprises an infrared receiver. A communication protocol is implemented in the circuit which automatically establishes an ad hoc, point-to-point communication link from the infrared transmitter to the infrared receiver as soon as the security container (20) arrives in direct proximity to the storage container (30). The protection mechanism changes automatically from the first into the second protection mode when it is located in proximity to the storage container (30).

19 Claims, 2 Drawing Sheets

SECURITY SYSTEM HAVING AD HOC NETWORKING OF INDIVIDUAL COMPONENTS

The present invention relates to a security system according to the preamble of claim 1 and a correspondingly equipped security container (e.g., a case or a currency cassette) according to the preamble of claim 16.

There are greatly varying security cases for transporting objects in need of protection, such as valuables like coins and banknotes, securities, other valuable objects such as precious metals and precious stones, documents to be kept secret, or possibly also toxic materials, rare materials, or material to be shielded in another way, such as radioactive material.

The security cases typically have a strongbox area, a protection system, and an access opening, which may be closed and makes the security case accessible in the open state.

The protection system is used for the purpose of protecting the owner or possessor of the valuables from a misuse of the valuables, if they are lost in the event of a theft. This is performed by automatically neutralizing and/or devaluing, in particular staining the valuables in such a case. The corresponding known protection systems are costly and complex.

There are numerous approaches for protecting the transport of the valuables in the various transport situations. Currently, the tendency is clearly in the direction of more complex systems, in which the mechanical or physical protection is improved and, in addition, electronic means are used to provide an intelligent protection system which supports or supplements the mechanical protection systems.

These systems increasingly require interventions on the part of the currency carrier or on the part of other individuals who participate in the transport or receipt of the transported objects. Approaches of this type are subject to breakdown and operating errors may occur. In addition, approach or attack points for unauthorized individuals result.

It is the object of the present invention,

- to provide a security system, which ensures high security, is as universally usable as possible, and may be handled simply, and
- to suggest a correspondingly equipped security container (such as a case or a currency cassette).

The present invention is to allow high flexibility in the ability to handle it and is to provide a security system which is cost-effective and secure.

This object is achieved according to the present invention

- for a security system by the characterizing features of claim 1, and
- for a security container by the characterizing features of claim 16.

Preferred refinements of the security system are defined by the dependent claims.

According to the present invention, a new path is followed, which allows high security to be offered at a reasonable price. One proceeds from an autonomous approach, which operates without intervention from the outside. The corresponding components establish a communication link with one another and the security container changes from one mode into another independently, i.e., adapted to the situation.

The protection system may comprise further protection means and/or security features which are situated in or on the security container. Such protection means are used for the purpose of protecting the security container against greatly varying types of attacks or in greatly varying situations.

As additional protection measures, the security system may comprise means for surface protection, which are insertable or installable in the security container and enclose a receptacle area. These means may be electrically connectable to the protection circuit in order to trigger the neutralization and/or staining of the valuables via the protection circuit in the event of an attempt to damage or penetrate the security container. Protective films, nets, gratings, or fabrics may be used as means for surface protection to ensure protection against breaking open, cutting through, or drilling through.

The protection system may also comprise an impact sensor as an additional protection measure, which is installable in the security container. The impact sensor is electrically connectable to the protection circuit and triggers the neutralization and/or staining of the valuables via the protection circuit upon a predefined number or frequency of impacts and/or concussions.

To further increase the security, a movement sensor may be provided, which is deactivated in the event of a manipulation or transport of the security container by individuals authorized for this purpose.

The protection system may be implemented in such a way that it is possible to access the receptacle area with or without actuating an additional auxiliary element such as a (contactless) key.

A further security precaution may be achieved using additional modules, which generates smoke in the event of unauthorized manipulation of the security system. This has a signal effect and prevents a perpetrator from carrying along the security container.

Still a further security precaution may comprise situating an airbag system in or on the security container. Such an airbag system must be conceived in such a way that it is activated or is activatable in the event of unauthorized handling of the security system. Unauthorized manipulations of the security system are made more difficult and a perpetrator is possibly prevented from carrying along the security container by the volume increase occurring upon actuation of the airbag system.

The new security container works together with other elements of the security system, as already noted, and results in a security system which is tailored to the situation and operates autonomously.

In particular, the security container may establish a communication link between the protection circuit and an external device, preferably a portable computer, via an interface.

Further features and characteristics of the present invention are explained in greater detail in the following on the basis of exemplary embodiments and with reference to the drawing.

Basically identical and/or identically acting constructive elements are provided with identical reference signs in the figures, even if they partially differ from one another. Specifications such as top, bottom, right, left, front, and rear relate to the position of the elements thus identified in the particular figures.

Because in practice the delivery and insertion of currency cassettes into ATMs and the removal/retrieval of currency cassette from ATMs is a frequent concern, the exemplary embodiments essentially relate to ATM-based security systems. The idea according to the present invention may also be transferred without further measures to other security systems for protecting valuables.

Figure 1:
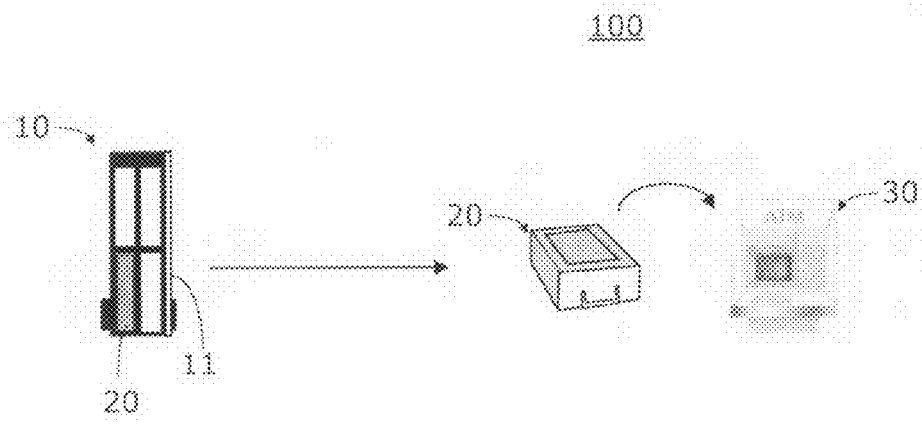
FIG. 1 shows a security system according to the present invention in a schematic view.

A first exemplary embodiment of a security system 100 is shown in FIG. 1. A transport trolley 10 (referred to here generally as a transport container) is shown on the left, whose door 11 is open. In the example shown, four compartments are provided in the transport container 10, which are each designed to accommodate one currency cassette 20. In the example shown, a currency cassette 20 (referred to here generally as a security container) is located in the transport container 10. The currency carrier brings the transport container 10 up to the ATM 30 (referred to here generally as a storage container). The currency transported in the currency cassette 20 is not removed here, but rather the currency cassette 20 together with the currency contained therein is introduced into the storage container 30.

The level of the security risk varies depending on the transport phase. For example, snatching the security container 20 is more possible as the security container 20 is removed from the transport container 10 than during the transport of the security container 20 enclosed in the transport container 10. As soon as the security containers 20 are in the storage container 30, the security is also higher again.

Experiments have shown that this way of viewing things only partially reflects the actual potential danger. In actuality, there are numerous aspects which have an influence on the security of the overall system 100. A not insignificant aspect is the human as an error source (for example, when incorrect operation occurs), or the human as a danger source (for example, when unauthorized theft or manipulation occurs).

The present invention is partially based on findings from cases which have resulted in the very recent past in the field of currency transport operations. In addition, observations which have been collected over years of daily practice play a role.

According to the present invention, an overall system is protected by a security system made of communication means communicating with one another ad hoc, which are situated in a decentralized way.

Such a security system is especially designed for storing and transporting valuables and comprises one more security containers 20 for receiving valuables, such as banknotes or the like. Each of the security containers 20 comprises a protective mechanism for protecting the valuables. First transport means 10 for receiving and transporting one or more security containers 20 are used. Furthermore, at least one storage container 30 for receiving and storing the security container(s) 20 is/are provided. The security containers 20 have an electrical circuit having an infrared receiver and have an optical window. The protective mechanism of the security container 20 is designed in such a way that the security container 20 may be put at least into a first protection mode or a second protection mode.

An electrical control circuit is provided in the first transport means 10, which comprises an infrared transmitter and an optical window. An electrical control circuit is also provided in the storage container 30, which comprises an infrared transmitter and an optical window.

A communication protocol is implemented in the electrical control circuit and the electrical circuit of the security container 20, which automatically establishes an ad hoc, point-to-point communication link from the infrared transmitters through the optical windows to the infrared receivers, as soon as the security container 20 arrives in proximity to the transport means 10 or the storage container 30. The cited protective mechanism of the security container 20 is in the first protection mode when the security container 20 is in direct proximity to the transport means 10. In contrast, when it is in direct proximity to the storage container 30, the protective mechanism of the security container 20 independently (i.e., automatically) changes into the second protection mode.

The protection system thus operates autonomously in the meaning of independently of user inputs. The currency carrier, for example, who performs the transport of the security containers 20 in the transport container 10, does not have access to the valuables at any time and has no or only a very restricted possibility of affecting the mode of the protection system.

In the following, a typical sequence is described to explain further details of the present invention on the basis of the sequence. After the valuables are introduced into a security container 20, its protection mechanism passes into an armed mode (carry mode). In this carry mode, certain physical sensors, which are thus provided, and virtual sensors (also referred to as virtual protection mechanisms), which are a part of the protection mechanism, are queried. If signs of an undesired situation result, the protection mechanism is triggered and the valuables are irrevocably devalued.

One or more of the following functions may be implemented using the virtual protection mechanism:

transport time monitoring, check time switching, sidewalk monitoring, strongbox monitoring.

Certain presets may be given to the security system. In the example described here, the protection mechanism comprises at least one timer, which monitors a route time (sidewalk monitoring and/or transport time monitoring) and is thus used as a virtual protection mechanism. The maximum permissible route time is predefined in the protection mechanism. For example, the maximum permissible route time may be 2 minutes. Within this route time, the security container 20 must change from the carry mode into a transport mode (also referred to as the first mode here). This change of the mode only occurs when the security container 20 is inserted into the transport container 10 and may establish an ad hoc communication link with the electrical control circuit of the transport container 10 therein. If the route time window expires without the mode change having occurred, depending on the embodiment, the protective mechanism may be triggered directly or a warning may be output and a residual time window may be predefined.

If the security container 20 recognizes the transport container 10 (in other words, if the security container 20 is capable of establishing a communication link with the transport container 10), the mode change occurs.

Other security conditions preferably apply and/or other limiting values and settings are preferably used in the transport mode. Because the security container 20 is better protected in the transport container 10, less strict requirements may be used. For example, a new maximum route time may be predefined in the transport mode, which may be significantly longer. Further parameters may also be considered. A further time window may also run in parallel to the route time window. Thus, for example, a total time may be predefined. If the security container 20 does not reach the starting point (such as the cash center) within 12 hours, the protection mechanism may trigger.

In this embodiment, a further mode change occurs as soon as the security container 20 is removed from the transport container 10 and inserted into an ATM (storage container 30). The security container 20 immediately recognizes that it is now located in the storage container 30. This recognition is possible if the security container 20 may establish a communication link with the storage container 30. If the security container 20 is located in the storage container 30, the security container 20 enters the ATM mode. In this mode, other conditions/rules again apply. For example, in the ATM mode, a position sensor which is provided on the security container 20 may be used (i.e., automatically activated). If the security container 20 is moved after it has changed into the ATM mode, or if concussions occur on the storage container 30, the protection mechanism is triggered.

Figure 2:
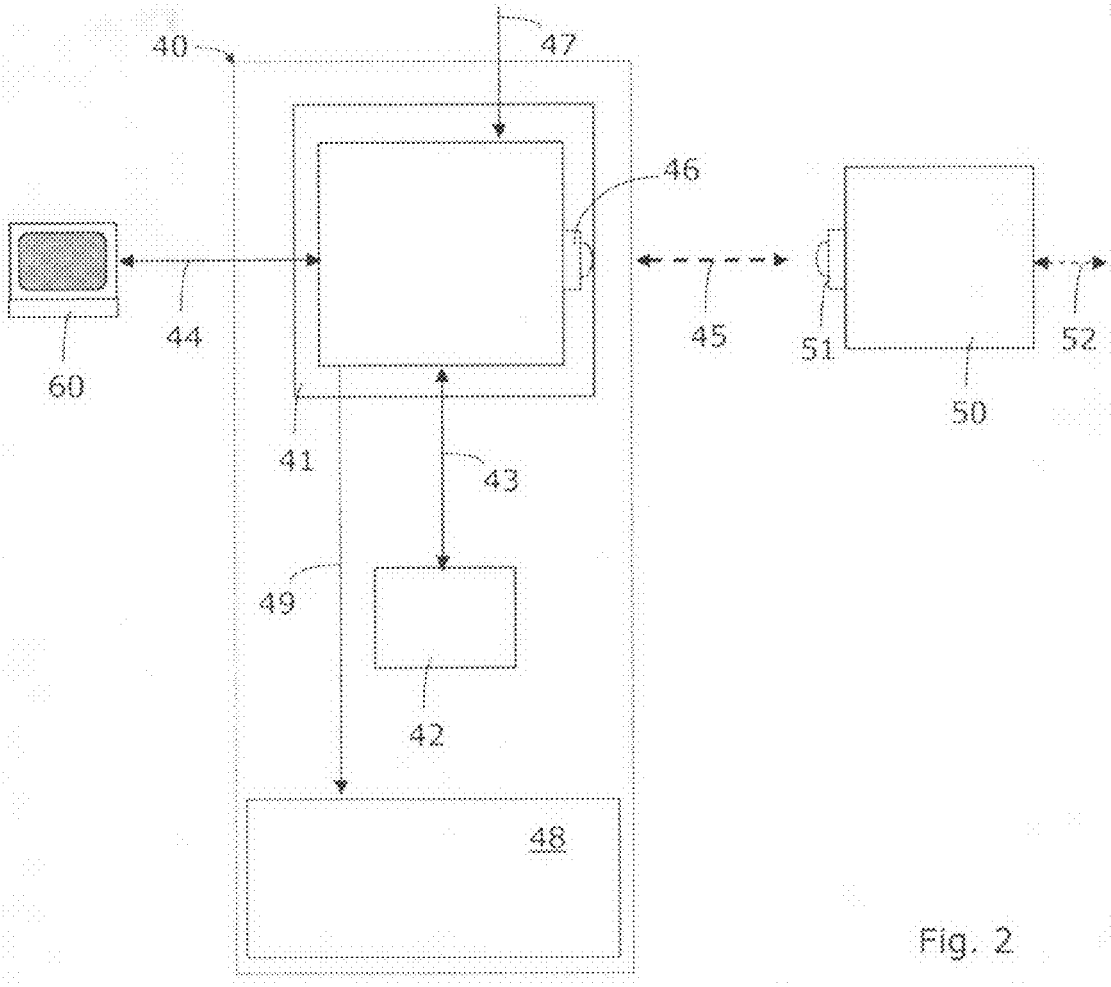
FIG. 2 shows a schematic view of several components of a security system according to the present invention in a specific embodiment.

FIG. 2 shows details of a possible embodiment of the present invention. The protection mechanism is identified by 40 and forms a logical unit made of multiple components. In the example shown, the protection mechanism 40 comprises an electrical protection circuit 41, which is equipped with an infrared receiver 46 (or an infrared transceiver). Furthermore, at least one interface 43 is provided to connect a sensor 42 (e.g., a position sensor). Moreover, the protection mechanism 40 comprises a system 48 for devaluing the valuables. The system 48 is connected via an interface 49 to the electrical protection circuit 41, to be able to be triggered therefrom. The protection mechanism 40 may be powered by a battery via a terminal 47, for example. Furthermore, an optional interface 44 (e.g., a serial interface) is provided to be able to connect the protection circuit 41 to a computer 60. Via this computer 60, for example, the parameters and other settings of the protection circuit 41 may be set. Via this path, for example, the route time may be adapted, or other presets may be made for the various modes.

The protection mechanism 40 establishes an ad hoc communication link 45 with an electrical circuit 50 of a transport container 10 or a storage container 30. This link is a direct point-to-point link, preferably an IrDA link. The electrical circuit 50 comprises an infrared transmitter 51, as shown.

The electrical protection circuit 41 preferably has further interfaces to be able to connect additional sensors, for example. In a preferred embodiment of the present invention, these interfaces are programmable or settable by the computer 60.

If the electrical circuit 50 is the circuit which is installed in an ATM (storage container 30), this electrical circuit 50 is connected to further security elements of the ATM. This connection is identified by 52 in FIG. 2. The connection 52 is preferably bidirectional, i.e., the circuit 50 may output signals to security elements of the ATM in order to stop the currency output at the ATM in the event of a manipulation of the security container 20. However, the circuit 50 may also receive signals from the ATM. Thus, for example, the devaluing of the valuables in a security container 20 may be triggered if a door of the ATM or a currency delivery channel is manipulated.

The infrared transmitters and the infrared receivers are preferably designed for encrypted communication. The infrared transmitters and infrared receivers are attached in the security container 20, in the transport container 10, and in the storage container 30. They are preferably provided with a theft or manipulation security device. This may be designed in such a way that the key necessary for communication is destroyed or changed for the encrypted communication. The communication is thus no longer possible.

The protection mechanism for protecting the valuables comprises or is connected to a system 48 for devaluing the valuables. The devaluing is typically performed in that the system 48 discharges a liquid suitable for this purpose, such as ink or etching liquid, onto the valuables under pressure, by which the valuables are stained.

The security containers cited may be known security cassettes, which are known, for example, from the Swiss Patent Application CH-01 532/04 of 17 Sep. 2004. The novel security cassette 20 differs from the typical security cassettes in particular in that it assumes the particular desired mode automatically, i.e., tailored to the situation and independently. Therefore, an additional PDA device and control activities which are performable manually are not needed.

However, cases like a hardside case may also be used as security containers. The essential advantages of these are that such hardside cases are cost-effective.

The transport container may be a transport trolley having wheels, a transport vehicle (such as a special vehicle), a portable container, or the like.

The infrared signal transmission occurs directly, specifically optically and autonomously, between the security container 20 and the transport container 10 and/or storage container 30. The entire transport and storage procedure is thus significantly simplified and the security is increased.

The protection devices of the security containers 20 have a sensor system which is designed for the purpose of detecting parameters of the particular situation of the security container 20 and causing the triggering of the protection device 48 in accordance with the present mode, if the actual situation of the security container 20 deviates from its setpoint situation.

This sensor system typically has multiple sensors for sensing different conditions. Depending on the object which the sensors have to fulfill, they are activated, deactivated, or their sensitivity is changed/adapted in accordance with the particular mode. The protection mechanism 40 may comprise one or more of the following sensors:

movement sensor,
position sensor,
impact sensor,
pressure sensor,
temperature sensor,
light sensor,
gas sensor.

Figure 3:
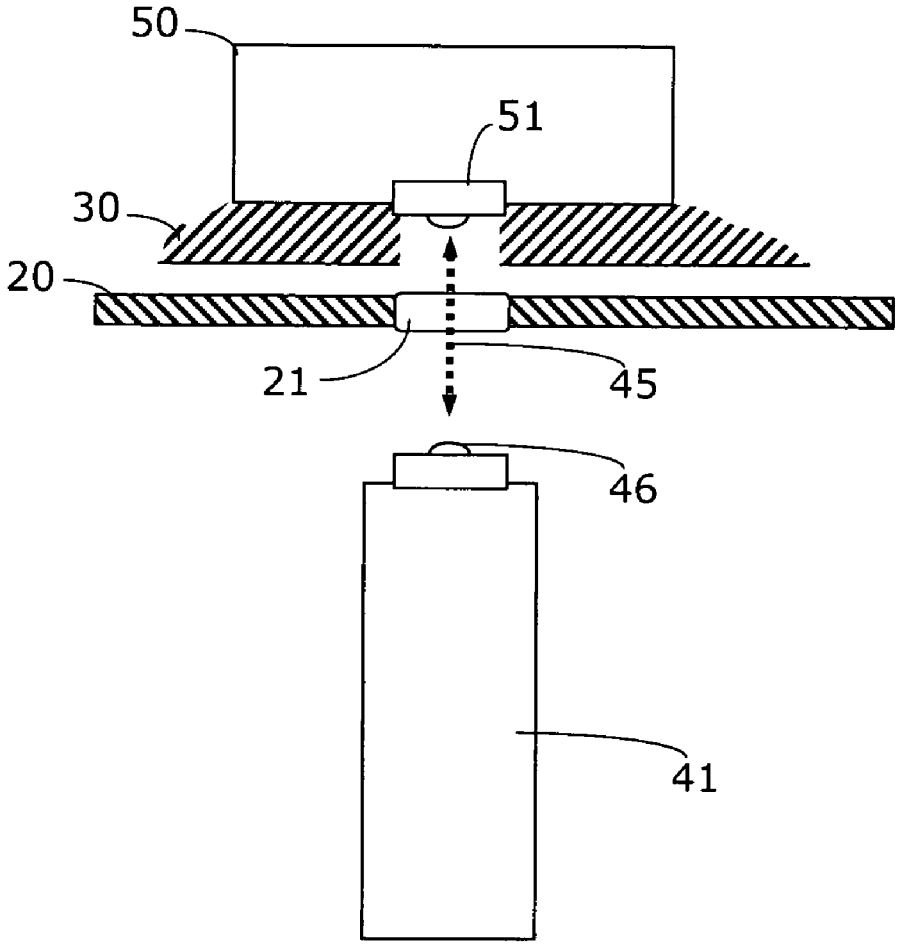
FIG. 3 shows a schematic sectional view of several components of a security system according to the present invention in a specific embodiment.

To allow the infrared communication between elements 10, 20, and 30 of the security system, an optical connection 45 must be possible. I.e., an optical window must be provided. The optical windows may be holes or openings in the containers, or they may be areas in or on the containers equipped with lenses or transparent components. The principle is indicated in FIG. 3. A schematic view through a part of a security container 20 and a part of the storage container 30 comprising the security container 20 is shown. An electrical control circuit 50 having an infrared transmitter 51 is located on or in the storage container 30. An electrical protection circuit 40 having an infrared receiver 46 is located on or in the security container 20. An optical window element 21 is provided in a wall of the security container 20, so that the communication link 45 may be established.

The invention claimed is:

1. A security system (100) for storing and transporting valuables, the security system (100) comprising:

at least one security container (20) for receiving valuables, each security container (20) comprising a protection mechanism (40) comprising an electrical protection circuit (41) for protecting the valuables, at least one storage container (30) for receiving and storing the at least one security container (20) and at least transport container (10) for separately receiving and transporting the at least one security container (20), characterized in that the electrical protection circuit (41) is provided in the security container (20), which comprises an infrared receiver (46), the protection mechanism (40) of the security container (20) being able to be put into a first protection mode and a second protection mode for protecting the security container (20) and its contents, an electrical control circuit (50), which comprises an infrared transmitter (51), is provided in the at least one storage container (30) and the at least one transport container (10), an optical window element (21) is provided in a wall of the security container (20) so that a communication link may be established between the infrared receiver (46) of the security container (20) and the infrared transmitter (51) of the storage container (30) or transport container (10), a communication protocol being implemented in the circuit (41, 50), which automatically establishes said communication link as an ad hoc, point-to-point communication link from the infrared transmitter (51) through the optical window (21) to the infrared receiver (46) as soon as the security container (20) arrives in direct proximity to the at least one storage container (30) or the at least one transport container (10), and the protection mechanism (40) is placed in the first protection mode when it is located in proximity to a transport container (10) as determined from the communication link, and changes automatically from the first into the second protection mode when it is located in proximity to a storage container (30).

2. The security system (100) according to claim 1, characterized in that, a communication protocol is implemented, which automatically establishes an ad hoc, point-to-point communication link from the infrared transmitter (51) to the infrared receiver (46) as soon as the security container (20) arrives in direct proximity to the transport container (10), in order to perform a mode change.

3. The security system (100) according to claim 1 or 2, characterized in that the protection mechanism (40) comprises one or more of the following sensors:

movement sensor,
position sensor (42),
impact sensor,
pressure sensor,
temperature sensor,
light sensor,
gas sensor.

4. The security system (100) according to claim 1 or 2, characterized in that the protection mechanism (40) comprises one or more of the following virtual protection mechanisms:

transport time monitoring,
check time circuit,
sidewalk monitoring,
strongbox monitoring.

5. The security system (100) according to one of claims 1 or 2, characterized in that the security container (20) automatically enters the first protection mode as soon as the security container (20) is inserted into the transport container (10) and the security container (20) may then be transported in the transport container (10), the security container (20) being secured against impact and/or opening in the first protection mode.

6. The security system (100) according to one of claims 1 or 2, characterized in that the security container (20) automatically enters the second protection mode as soon as the security container (20) is inserted into the storage container (30) and the security container (20) is stored in the storage container (30), the security container (20) being secured against impact and/or opening and/or movement in the second protection mode.

7. The security system (100) according to claim 6, characterized in that the electrical control circuit (50) of the storage container (30) is connected to other electrical elements of the storage container (30) via an interface (52) in order to activate the protection mechanism (40) of the security container (20) in one or more of the following cases:

unauthorized opening of a door, flap, or shutter on the storage container (30),
unauthorized manipulation of the storage container (30),
movement of the storage container (30),
heat or light or gas activity on the storage container (30).

8. The security system (100) according to claim 1, characterized in that the security container (20) is a case, preferably a hardside case, or a currency cassette, preferably an ATM currency cassette.

9. The security system (100) according to claim 8, characterized in that the protection mechanism (40) automatically devalues the valuables after activation, this preferably being performed by the use of staining or etching liquid.

10. The security system (100) according to claim 1, characterized in that the communication protocol is an IrDA protocol.

11. The security system (100) according to claim 10, characterized in that the communication protocol is designed in such a way that the ad hoc, point-to-point communication link from an infrared transmitter (51) to an infrared receiver (46) is encrypted, a customer-specific encryption preferably being predefinable.

12. The security system (100) according to claim 1, characterized in that both the security container (20) and also the storage container (30) comprise infrared receivers (46) and infrared transmitters (51), to be able to communicate with one another bidirectionally.

13. The security system (100) according to claim 12, characterized in that the infrared transmitter (51) is operated at a low transmission power, in order to limit the operating distance between infrared transmitter (51) and infrared receiver (46) to less than 50 cm, preferably less than 30 cm.

14. The security system (100) according to claim 1, characterized in that the electrical control circuit (50) has one or more of the following interfaces in addition to the infrared transmitter (51):

a serial interface (44), for example, for connecting a computer (60) or PDA,
a configurable input/output (43) for connecting sensors (42) or peripheral circuits.

15. The security system (100) according to claim 1, characterized in that a display is provided to display which protection mode the security container (20) is currently in.

16. A security container (20) for receiving valuables and for use in a security system (100) according to claim 1, characterized in that the security container (20) comprises an integrated protection mechanism (40) for protecting the valuables, having an electrical protection circuit (41), which has an infrared receiver (46), the protection mechanism (40) of the security container (20) changing automatically and autonomously from a first protection mode into a second protection mode and/or vice versa depending on the situation.

17. The security container (20) according to claim 16, characterized in that the protection mechanism (40) comprises one or more of the following sensors:

movement sensor,
position sensor (42),
impact sensor,
pressure sensor,
temperature sensor,
light sensor,
gas sensor.

18. The security container (20) according to claim 16 or 17, characterized in that the protection mechanism (40) comprises one or more of the following virtual protection mechanisms:

transport time monitoring,
check time circuit,
sidewalk monitoring,
strongbox monitoring.

19. The security container (20) according to claim l6, characterized in that the security container (20) is a case, preferably a hardside case, or a currency cassette, preferably an ATM currency cassette.

* * * * *